United States Patent [19]

Russell et al.

[11] Patent Number: 4,665,706

[45] Date of Patent: May 19, 1987

[54] CONTROL SYSTEM FOR VARIABLE PRESSURE ONCE-THROUGH BOILERS

[75] Inventors: Thomas D. Russell, Montville; Robert R. Walker, Euclid, both of Ohio

[73] Assignee: The Babcock & Wilcox Company, New Orleans, La.

[21] Appl. No.: 767,672

[22] Filed: Aug. 21, 1985

Related U.S. Application Data

[63] Continuation of Ser. No. 593,202, Mar. 27, 1984, abandoned, which is a continuation of Ser. No. 262,844, May 12, 1981, abandoned.

[51] Int. Cl.[4] ..... F01K 13/02

[52] U.S. Cl. ..... 60/646; 60/652; 60/660

[58] Field of Search ..... 60/646, 652, 660

[56] References Cited

U.S. PATENT DOCUMENTS

| | | | |
|---|---|---|---|
| 3,175,367 | 3/1965 | Gorzegno et al. | 60/646 |
| 3,194,217 | 7/1965 | Grabowski | 60/646 X |
| 3,271,961 | 9/1966 | Wiener | 60/646 |

*Primary Examiner*—Allen M. Ostrager
*Attorney, Agent, or Firm*—Vytas R. Matas; Robert J. Edwards

[57] ABSTRACT

A system for the operation of once-through boilers which utilizes variable throttle pressure over a very wide load operating range is disclosed. The system utilizes a valving arrangement permitting the turbine valve (22) to be opened to a predetermined open position, typically 70 percent of its full open position, as soon as possible during the system loading process, maintaining the turbine valve (22) in this predetermined open position while the flow of steam from the boiler is being varied by a control valve (40) and the output pressure of the boiler is varying accordingly, and then allowing the turbine valve (22) to open further from the predetermined open position when the system reaches full design pressure so as to vary the flow of steam from the boiler while the output pressure thereof is maintained substantially constant. In this manner, the boiler is operated at a variable output pressure over a very wide load operating range.

3 Claims, 3 Drawing Figures

MWe = MEGAWATT ERROR
FPe = FURNACE PRESSURE ERROR
SHTe = SUPERHEAT TEMP ERROR
FWT = FEEDWATER TEMP
FR = FIRING RATE

CONTROL SYSTEM FOR VARIABLE PRESSURE ONCE-THROUGH BOILERS

This application is a continuation of application Ser. No. 593,202 filed Mar. 27, 1984, now abandoned, which is a continuation of parent application Ser. No. 262,844, filed May 12, 1981, now abandoned.

TECHNICAL FIELD

The present invention relates generally to the operation of the boilers, and more particularly to a control system for operating variable pressure once-through units.

BACKGROUND ART

In a variable pressure boiler system, the throttle pressure varies with the load. In its ideal form, the throttle valves on the turbine are left wide open and the throttle pressure varies directly with the load. Such variable pressure operation is desirable since it can increase the efficiency of the turbine. However, the primary incentive for variable pressure operation is that it can increase the number of times that the turbine can be loaded and unloaded. This is because with variable pressure operation, the change in the first stage steam exit temperature in the turbine is relatively minor, thus minimizing thermal stress in the metal comprising the turbine. In contrast, in a constant pressure type of operation, the first stage steam exit temperature is load dependent. This can result in a greater change in temperature for the turbine which, in turn, can cause excessive metal fatigue.

Becuse of the foregoing, it has become desirable to develop a control system for the operation of a once-through boiler so that a variable throttle pressure type of operation can be utilized over a very wide load range.

SUMMARY OF THE INVENTION

The present invention solves the aforementioned problems associated with the prior art as well as other problems by providing a control system so that variable throttle pressure operation can be introduced at as low a load as possible and can be utilized for most of the load operating range. This is accomplished by opening the turbine valve to approximately 70 percent of its full open position as soon as possible as the system is being loaded, utilizing a flash tank while this is occurring until the load demand exceeds the minimum feedwater flow requirements, and then allowing the system to assume the variable throttle pressure mode of operation as load is increased until throttle pressure approximates designed operating pressure, at which time the turbine valve is regulated to meet load requirements. In essence, the system provides for variable pressure operation from approximately 20 percent to 75 percent of load and also provides for smooth transition from low load operation to the variable pressure mode of operation, and from the variable pressure mode of operation to the full pressure mode of operation. In addition, while in the variable pressure mode of operation, a control coordinator is provided to monitor and correct steam flow, firing rate and feedwater flow. In this manner, the system can automatically adjust and compensate for deviations in these parameters from that which is desired.

In view of the foregoing, it will be seen that one aspect of the present invention is to provide a control system which permits variable throttle pressure operation of a once-through boiler.

Another aspect of the present invention is to provide a control system in which a once-through boiler can be operated in a variable pressure mode of operation over a wide load range.

Still another aspect of the present invention is to provide a control system for a once-through boiler in which there is a smooth transition from the low load type of operation to the variable pressure mode of operation, and from the variable pressure mode of operation to the full pressure mode of operation.

These and other aspects of the present invention will become more clearly understood after a review of the following description of the preferred embodiment when considered with the following drawings.

DESCRIPTION OF THE PREFERRED EMBODIMENT

Figure 1:
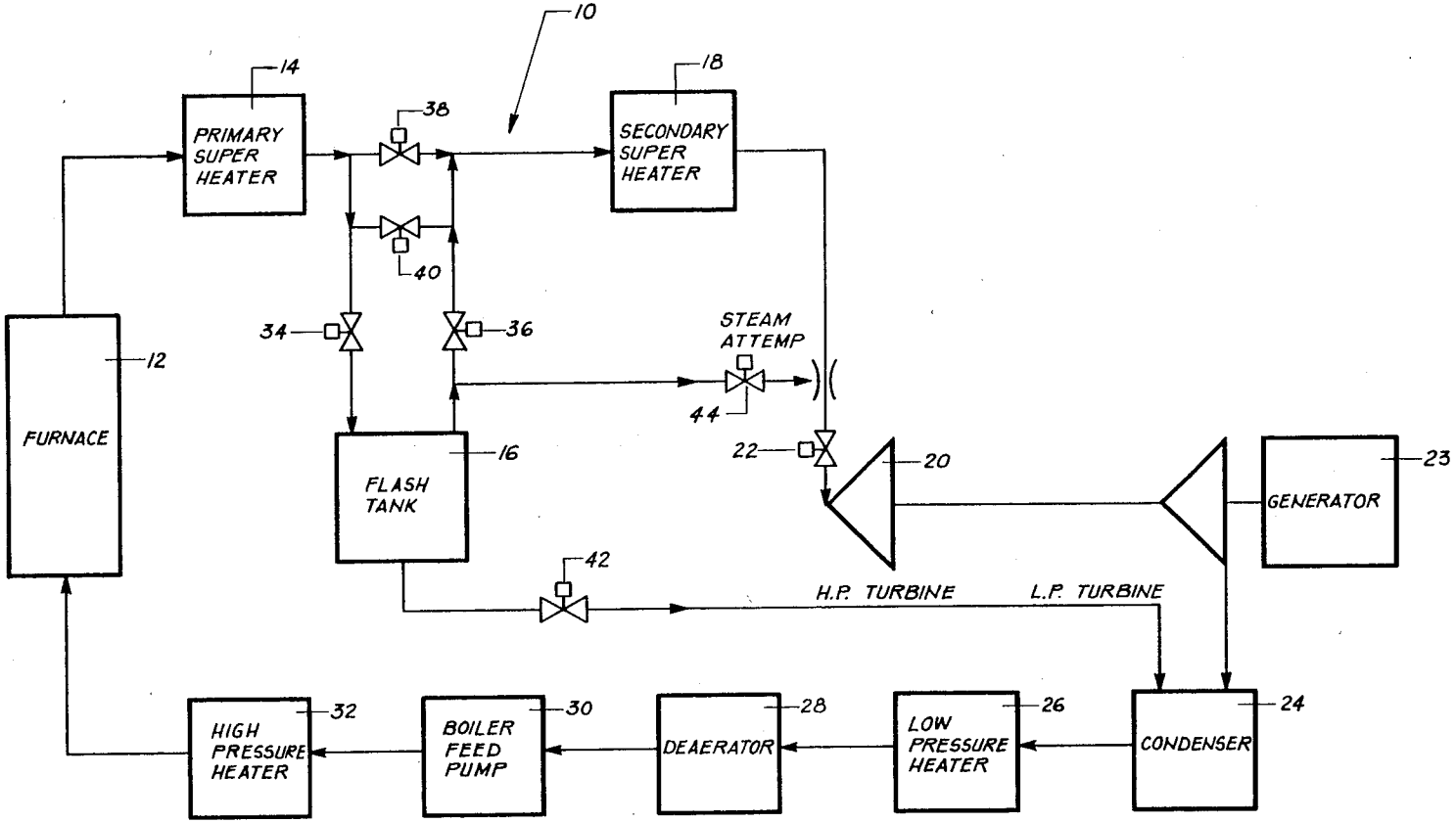
FIG. 1 is a schematic diagram of the system which utilizes the invention of this disclosure.

Referring now to the drawings where the illustrations are for the purpose of describing the presently known preferred embodiment of the present invention and are not intended to limit the invention hereto, FIG. 1 is a schematic drawing of the system 10 used by the apparatus of the present invention. System 10 is comprised primarily of a furnace 12 whose output is connected to the input to a primary superheater 14, a flash tank 16, a secondary superheater 18 whose output is connected to the input to a turbine 20 via a turbine valve 22, a generator 23, and a condenser 24. The condenser 24 is connected to the input to the furnace 12, via a low pressure heater 26, a deaerator 28, a boiler feed pump 30, and a high pressure heater 32.

The primary superheater 14 is connected to the input to the flash tank 16 via a valve 34 and the flash tank 16 is connected to the secondary superheater 18 via a valve 36. A pair of valves 38 and 40 are connected in parallel across the input to valve 34 and the output of valve 36. A valve 42 is provided between the flash tank 16 and the condenser 24 and controls the flow of water from the flash tank 16 to the condenser. A superheated steam attemperator valve 44 is provided between the output of the secondary superheater 18 and the flash tank 16.

Figure 2:
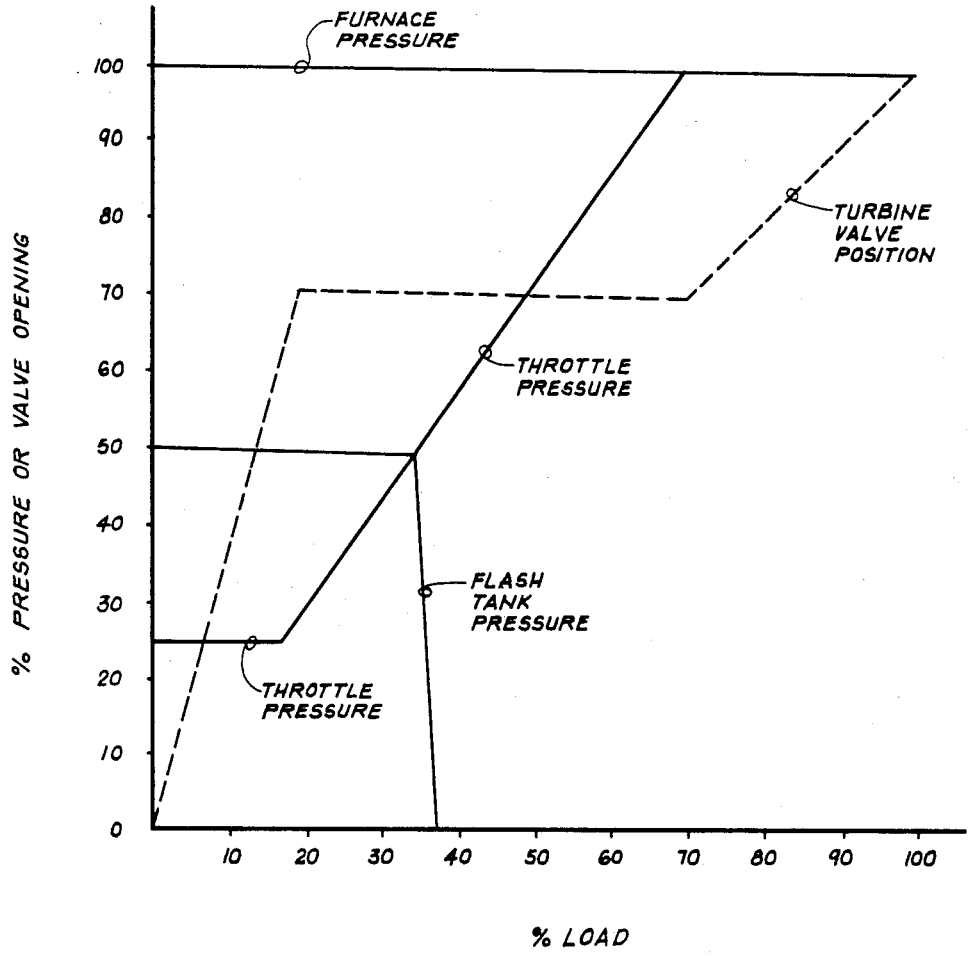
FIG. 2 is a graph of percent pressure or valve opening verses percent load and illustrates flash tank pressure, furnace pressure, turbine valve position and throttle pressure.

As for the principle of operation for this system, refer to FIG. 2. In FIG. 2, percent pressure or valve opening is shown verses percent load, and illustrates flash tank pressure, furnace pressure, turbine valve position and throttle pressure. The objective is to obtain variable throttle pressure at as low a load as possible, provide a smooth transition from low load operation to once-through operation, and incorporate the capabilities of control coordinator 50, shown on FIG. 3, during the variable throttle pressure phase of operation. This is accomplished by opening the turbine valve 22 as soon as possible, by operating the flash tank 16 until it is dry and by using valves 38 and 40 between the primary superheater 14 and the secondary superheater 18 as throttle valves, as will be hereinafter described. The unique feature of this control strategy is that throttle pressure is not directly controlled, except at minimum pressure, but is permitted to float to whatever level is required for the desired load. Thus, variable pressure operation is achieved over a very substantial portion of the load range.

Figure 3:
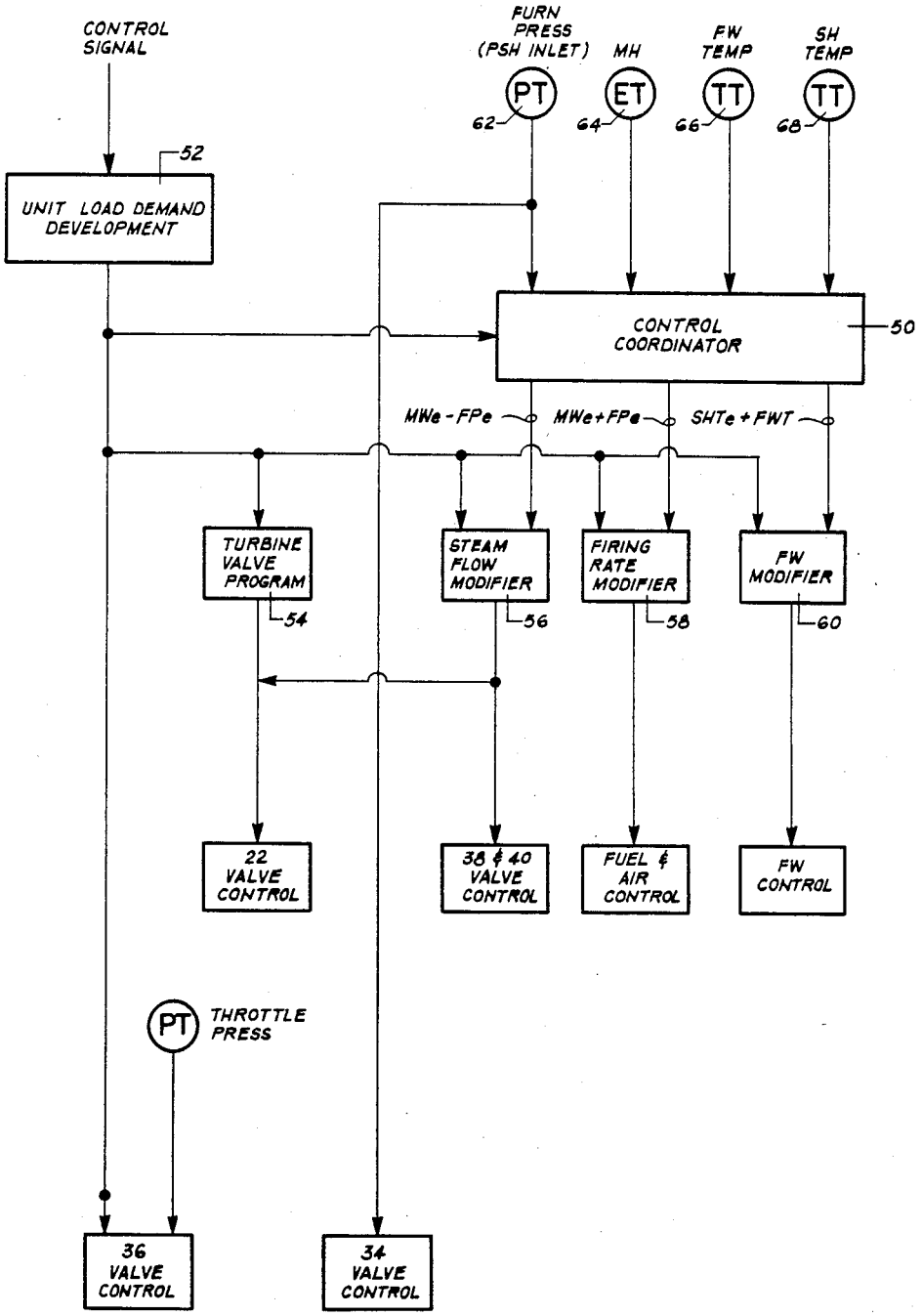
FIG. 3 is a schematic diagram which illustrates the overall system utilized by the invention of this disclosure.

In order to accomplish the foregoing, a system organization schematic is illustrated in FIG. 3. In this Figure, an incoming control signal is applied to the unit load demand development function 52, the output of which is directed to the control coordinator 50 and to a turbine valve program 54, a steam flow modifier 56, a firing rate modifier 58, a feedwater modifier 60, and controls for valve 36. The turbine valve program 54 controls the operation of a turbine valve 22, the steam flow modifier 56 controls the operation of valves 38 and 40, the firing rate modifier 50 controls the fuel and air mixtures in the system, and the feedwater modifier 60 regulates the flow of feedwater throughout the system. A pressure transmitter 62 is connected to both control coordinator 50 and to the control valve 34, and an electrical transmitter 64, a feedwater temperature transmitter 66 and a superheater temperature transmitter 68 are also connected as inputs to the control coordinator 50 which, in turn, regulates the steam flow modifier 56, the firing rate modifier 58 and the feedwater modifier 60 by means of control signals generated therein.

With respect to this control system, there are basically three modes of operation—low load operation, once-through variable pressure operation, and full pressure operation. Low load operation occurs when the boiler feedwater flow is limited to its minimum flow rate. Once-through variable pressure operation occurs when the feedwater flow rate exceeds its minimum flow rate and continues until throttle pressure reaches full design pressure, i.e., furnace pressure. Full pressure operation occurs when the throttle pressure has reached full design pressure and continues until full load is achieved.

During the low load phase of operation, i.e., between 0 and approximately 25 percent load, the throttle pressure is maintained constant and the turbine valve 22 is rapidly opened to approximately 70 percent of its full open position, as shown in FIG. 2. In this mode of operation, valves 38 and 40 are closed and valves 34 and 36, along with the turbine valve 22, are opened. Valve 34 controls furnace pressure, whereas valve 36 controls throttle pressure. Valve 42 is also opened and regulates the water level in the flash tank 16. During this phase of operation, all flow from the furnace 12 is directed to the flash tank 16 and starts as water, and as firing is increased, becomes steam. The flash tank 16 acts as a steam and water separator and directs the water to the condenser 24 and the steam to the turbine 20. By the time steam flow to the turbine 20 equals the minimum feedwater flow rate of approximately 25 percent, the flash tank 16 has dried up. At that time, valve 40 opens and valves 34 and 36 start closing, stopping the flow to the flash tank 16. This occurs at approximately 25 percent of load and starts the next phase of operation, i.e., the variable throttle pressure phase or once-through variable pressure phase of operation.

In the once-through variable pressure phase or variable throttle pressure phase of operation, the turbine valve 22 is maintained at approximately 70 percent of its full open position by the turbine valve program 54. During this phase of operation, steam flow control is regulated by valve 40 and this valve, in essence, acts as a remote throttle valve. In this phase of operation, the feedwater flow is given the responsibility of controlling steam temperature, whereas the firing rate controls the load, and throttle pressure is permitted to float to whatever value is necessary to satisfy the load requirements. The control coordinator 50 assumes an important function in this phase of operation since it produces error or correction signals to the steam flow modifier 56, the firing rate modifier 58 and the feedwater modifier 60. These error or correction signals are as follows: A megawatt error minus a furnace pressure error control signal which is directed to the steam flow modifier 56, a megawatt error plus a furnace pressure error control signal which is directed to the firing rate modifier 58, and a superheat temperature error plus a feedwater temperature control signal which is directed to the feedwater modifier 60. In this manner, the feedwater flow can be adjusted to maintain steam temperature while the steam flow and the firing rate can be corrected to maintain proper furnace pressure and megawatts.

When valve 40 approaches its full open position, valve 38 starts opening and turbine valve 22 is permitted to start opening further from its 70 percent open position. This commences the next phase of operation, i.e., the full phase of operation.

In the full pressure phase of operation, throttle pressure reaches full design pressure and the turbine valve 22 is allowed to open still further to maintain the load as is necessary. In this mode of operation, the steam flow is controlled by the turbine valve 22 rather than by valve 40, and the combined capacity of valves 38 and 40 is sufficient to provide the steam flow required by turbine valve 22 as it further opens from its 70 percent open position. It should be noted that with respect to non-variable pressure once-through boiler systems, as in the prior art, this is the normal mode of operation once above the minimum feedwater flow rate, and thus, a variable pressure phase is never introduced therein.

The foregoing control system produces a number of benefits. For example, by using variable pressure the first stage steam temperature can be closely controlled which permits the rapid loading of the turbine without creating excessive thermal stress. In addition, the foregoing system provides for quickly achieving variable pressure operation, turbine metal temperature matching, and the smooth transition to once-through operation. And lastly, the control coordinator regulates and controls the overall operation of the system in the variable pressure phase of operation and adjusts the system components to compensate for various operational deviations.

Certain modifications and improvements will occur to those skilled in the art upon reading the foregoing. It should be understood that all such modifications and improvements have been deleted herein for the sake of conciseness and readability but are properly within the scope of the following claims.

We claim:

1. A method of controlling a power plant assembly during low load operation, comprising:

directing the flow of fluid exiting from a primary superheater of said power plant assembly through a flash tank, a secondary superheater, and thence through a turbine valve of a turbine, wherein said turbine valve is opened approximately 70% of its full open position, during said low load operation;

controlling the furnace pressure in a furnace of said power plant assembly at a first constant value by means of a first valve, located at the inlet of said flash tank, during said low load operation;

controlling the throttle pressure at said turbine valve at a second constant value, less than said first constant value, by means of a second valve, located at the steam outlet of said flash tank, during said low load operation; and regulating the water level in said flash tank by means of a third valve, located at the water outlet of said flash tank, which allows excess water in said flash tank to be drained off to a condenser of said power plant assembly.

2. A method of controlling a power plant assembly during once-through variable pressure operation, comprising:

directing the flow of fluid exiting from a primary superheater of said power plant assembly directly to a secondary superheater of said power plant assembly by means of a valve, and thence through a turbine valve of a turbine, thereby bypassing a flash tank of said power plant assembly, during said once-through variable pressure operation; and allowing the throttle pressure of the steam at said turbine valve of a turbine to vary in response to the load requirements of the power plant assembly, said turbine valve being opened approximately 70% of its full open position, during said once-through variable pressure operation.

3. A method of controlling a power plant assembly during full pressure operation, comprising:

directing the flow of fluid exiting from a primary superheater of said power plant assembly directly to a secondary superheater of said power plant assembly by means of a valve, and thence through a turbine valve of a turbine, thereby bypassing a flash tank of said power plant assembly, wherein the throttle pressure at said turbine valve is at a first constant value, and wherein said turbine valve is permitted to further open from a position of approximately 70% of its full open position, in response to the load requirements of the power plant assembly, during said full pressure operation.

* * * * *